US009126411B2

(12) United States Patent
Visnyak et al.

(10) Patent No.: US 9,126,411 B2
(45) Date of Patent: Sep. 8, 2015

(54) FLUID-JET PRECISION-DISPENSING DEVICE HAVING ONE OR MORE HOLES FOR PASSING GASEOUS BUBBLES, SLUDGE, AND/OR CONTAMINANTS DURING PRIMING

(75) Inventors: Elizabeth A. Visnyak, San Diego, CA (US); Glenn T. Haddick, San Diego, CA (US); Jaynie Schonbrod, Corvallis, OR (US); Holli Ogle, Corvallis, OR (US); Ralph L. Stathem, Lebanon, OR (US); Garrett E. Clark, Corvallis, OR (US); Jeffrey S. Hess, Corvallis, OR (US); Phil Harding, Albany, OR (US); Manish Giri, Corvallis, OR (US); Gilbert G. Smith, Corvallis, OR (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 776 days.

(21) Appl. No.: 12/993,184

(22) PCT Filed: May 25, 2008

(86) PCT No.: PCT/US2008/064814

§ 371 (c)(1),
(2), (4) Date: Mar. 9, 2011

(87) PCT Pub. No.: WO2009/145759

PCT Pub. Date: Dec. 3, 2009

(65) Prior Publication Data

US 2011/0181673 A1 Jul. 28, 2011

Related U.S. Application Data

(63) Continuation-in-part of application No. 10/872,215, filed on Jun. 18, 2004, now Pat. No. 7,625,080.

(51) Int. Cl.
*B41J 2/135* (2006.01)
*B41J 2/14* (2006.01)
(Continued)

(52) U.S. Cl.
CPC ..... *B41J 2/1707* (2013.01); *B41J 2202/07* (2013.01)

(58) Field of Classification Search
USPC ..... 347/92
See application file for complete search history.

(56) References Cited

U.S. PATENT DOCUMENTS 5,394,181 A * 2/1995 Braun ..... 347/92
6,179,414 B1 * 1/2001 Keefe et al. ..... 347/65
(Continued)

FOREIGN PATENT DOCUMENTS

CN 1229031 A 9/1999
EP 1260372 11/2002
(Continued)

*Primary Examiner* — Stephen Meier
*Assistant Examiner* — Alexander D Shenderov

(57) ABSTRACT

A fluid-jet precision-dispensing device includes a layer, one or more first holes within the layer, and one or more second holes within the layer. The first holes are adapted to pass fluid therethrough during usage of the device to precisely dispense the fluid at accurately specified locations. The second holes are adapted to not pass the fluid therethrough during usage of the device to precisely dispense the fluid at the accurately specified locations. The second holes may be adapted to at least substantially maximally pass gaseous bubbles therethrough during performance of a priming operation of the device. The second holes may be adapted to at least substantially maximally pass sludge and/or contaminants therethrough during performance of the priming operation of the device.

17 Claims, 6 Drawing Sheets

(51) Int. Cl.
*B41J 2/145* (2006.01)
*B41J 2/17* (2006.01)

(56) References Cited

U.S. PATENT DOCUMENTS 6,637,865 B1 * 10/2003 Murakami et al. ..... 347/56
7,758,177 B2 * 7/2010 Brown et al. ..... 347/93
2005/0280680 A1 12/2005 Hess et al.
2007/0081043 A1 * 4/2007 Silverbrook ..... 347/61

FOREIGN PATENT DOCUMENTS

JP 02078567 3/1990
KR 100524570 11/2005

* cited by examiner

FLUID-JET PRECISION-DISPENSING DEVICE HAVING ONE OR MORE HOLES FOR PASSING GASEOUS BUBBLES, SLUDGE, AND/OR CONTAMINANTS DURING PRIMING

RELATED APPLICATIONS

The present application is a continuation-in-part of the previously filed patent application entitled "air management in a fluid ejection device," filed Jun. 18, 2004, and assigned Ser. No. 10/872,215, now U.S. Pat. No. 7,625,080.

BACKGROUND

A common way to form images on media, such as paper, is to use a fluid-ejection device, such as an inkjet-printing device. An inkjet-printing device has a number of inkjet-printing mechanisms, such as inkjet printhead assemblies. Each inkjet printhead assembly has a printhead die having a number of inkjet nozzles that eject ink, such as differently colored ink, in such a way as to form a desired image on the media.

A printhead assembly can be prone to the formation or inclusion of gaseous bubbles, sludge, and/or contaminants therewithin. To ensure that such gaseous bubbles, sludge, and contaminants do not affect image quality during image formation, priming may be periodically performed. Priming desirably expels any gaseous bubbles and removes any sludge and contaminants.

DETAILED DESCRIPTION

Figure 1:
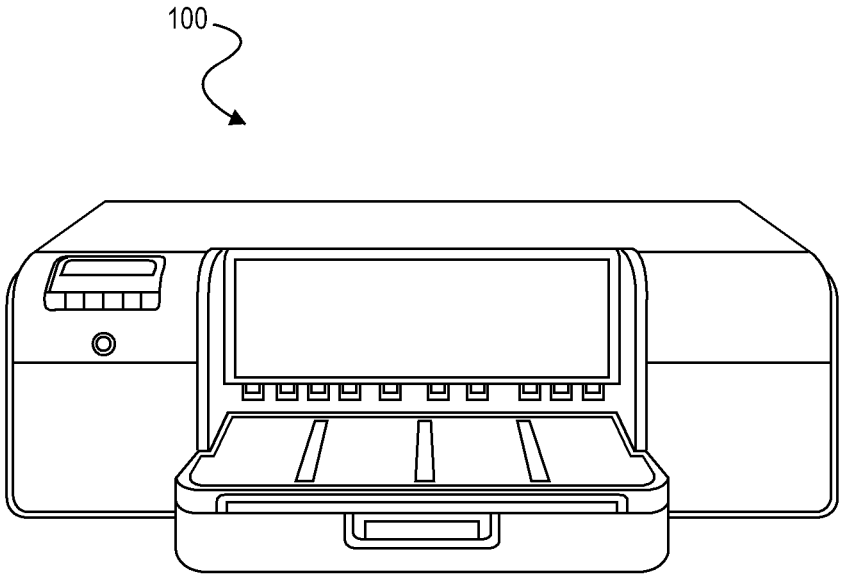
FIG. 1 is a diagram of a representative inkjet-printing device, according to an embodiment of the present disclosure.

FIG. 1 shows a representative inkjet-printing device 100, according to an embodiment of the present disclosure. The inkjet-printing device 100 is a device, such as a printer, that ejects ink onto media, such as paper, to form images, which can include text, on the media. The inkjet-printing device 100 is more generally a fluid-jet precision-dispensing device that precisely dispenses fluid, such as ink, as is described in more detail later in the detailed description.

The inkjet-printing device 100 may eject pigment-based ink, dye-based ink, or another type of ink. Differences between pigment-based inks and dye-based inks can include that the former may be more viscous than the latter, among other differences. In these and other types of ink, the ink may be generally considered as having at least a liquid component, and may also have a solid component in the case of pigment-based inks in particular. The liquid component may be water, alcohol, and/or another type of solvent or other type of liquid, whereas the solid component may be pigment, or another type of solid.

While the detailed description is at least substantially presented herein to inkjet-printing devices that eject ink onto media, those of ordinary skill within the art can appreciate that embodiments of the present disclosure are more generally not so limited. In general, embodiments of the present disclosure pertain to any type of fluid-jet precision-dispensing device that dispenses a substantially liquid fluid. A fluid-jet precision-dispensing device is a drop-on-demand device in which printing, or dispensing, of the substantially liquid fluid in question is achieved by precisely printing or dispensing in accurately specified locations, with or without making a particular image on that which is being printed or dispensed on. As such, a fluid-jet precision-dispensing device is in comparison to a continuous precision-dispensing device, in which a substantially liquid fluid is continuously dispensed therefrom. An example of a continuous precision-dispensing device is a continuous inkjet-printing device, for instance.

The fluid-jet precision-dispensing device precisely prints or dispenses a substantially liquid fluid in that the latter is not substantially or primarily composed of gases such as air. Examples of such substantially liquid fluids include inks in the case of inkjet-printing devices. Other examples of substantially liquid fluids include drugs, cellular products, organisms, fuel, and so on, which are not substantially or primarily composed of gases such as air and other types of gases, as can be appreciated by those of ordinary skill within the art. Therefore, while the following detailed description is described in relation to an inkjet-printing device that ejects ink onto media, those of ordinary skill within the art will appreciate that embodiments of the present disclosure more generally pertain to any type of fluid-jet precision-dispensing device that dispenses a substantially liquid fluid as has been described in this paragraph and the preceding paragraph.

Figure 2:
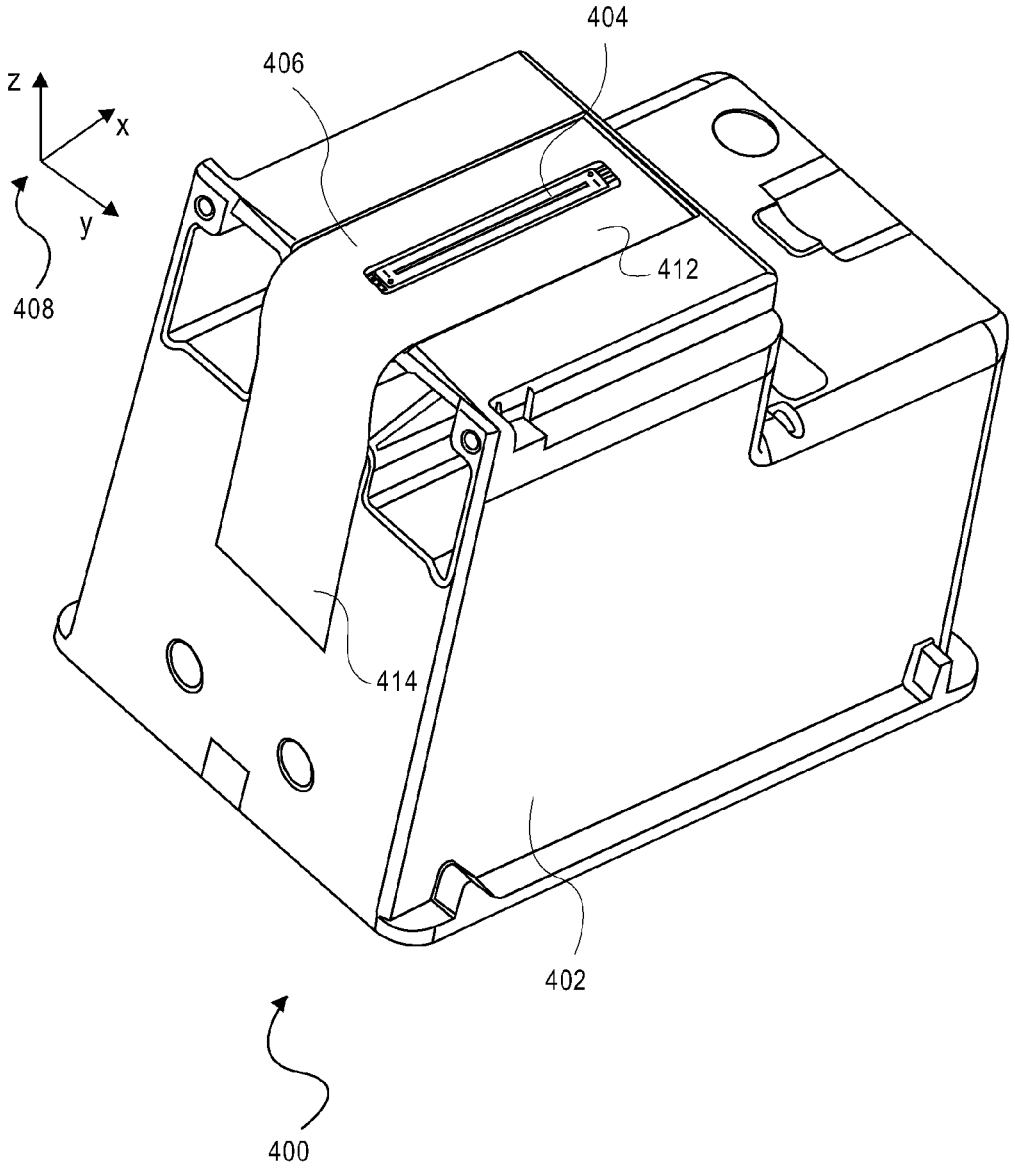
FIG. 2 is a diagram of an inkjet printhead, according to an embodiment of the present disclosure.

FIG. 2 shows a detailed view of an inkjet printhead 400, according to an embodiment of the present disclosure. The inkjet printhead 400 is more generally a cartridge or a cartridge assembly, and most generally a fluid-jet precision-dispensing device cartridge assembly. Reference number 408 denotes the x-, y-, and z-axes in FIG. 2. The inkjet printhead 400 is more generally a fluid-ejection mechanism, in that it is the actual mechanism that ejects fluid, such as ink, onto media to form images on the media. The inkjet printhead 400 may also be referred to as an inkjet printing device printhead assembly, or just an inkjet printhead assembly. The inkjet printhead 400 may further be referred to as simply a device, such as a fluid-jet precision-dispensing device, where the terminology "device" is used herein in a general sense.

The inkjet printhead 400 is inserted into the inkjet-printing device 100. There may be one or more such inkjet printheads that are inserted into the inkjet-printing device 100. Each inkjet printhead may have supplies of one or more differently colored inks, such as black ink, cyan ink, magenta ink, yellow ink, as well as other colored inks. In another embodiment, the inkjet printheads do not contain supplies of ink, such that there can be one or more inkjet cartridges that contain supplies of inks, and that are separate from the inkjet printheads.

The inkjet printhead 400 is depicted in FIG. 2 as including a housing 402, a printhead die 404, and a flexible circuit 406. The printhead die 404 is more generally a fluid-jet precision-dispensing device die, and may most simply be referred to as a fluid-jet precision-dispensing device as well, where the terminology "device" is used in its most general sense. Those of ordinary skill within the art can appreciate that the inkjet printhead 400 may include other components in addition to those depicted in FIG. 2.

The printhead die 404 is attached or otherwise disposed to the housing 402. The printhead die 404 includes a number of inkjet nozzles that eject ink, such as differently colored ink. The inkjet nozzles of the printhead die 404 are not particularly called out in FIG. 2. Furthermore, the flexible circuit 406 bends at an edge of the housing 402, such that the flexible circuit 406 is wrapped around the housing 402.

A first portion 412 of the flexible circuit 406 is electrically coupled to the printhead die 404 at ends of the die 404. A second portion 414 of the flexible circuit 406 is attached to the housing 402 itself. Upon insertion of the housing 402 of the inkjet printhead 400 into an inkjet printing device, the second portion 414 of the flexible circuit 406 makes electrical contact with the inkjet printing device. In this way, the flexible circuit 406 electrically couples the inkjet printing device with the printhead die 404 so that the printing device is able to control ejection of ink from the die 404.

Figure 3:
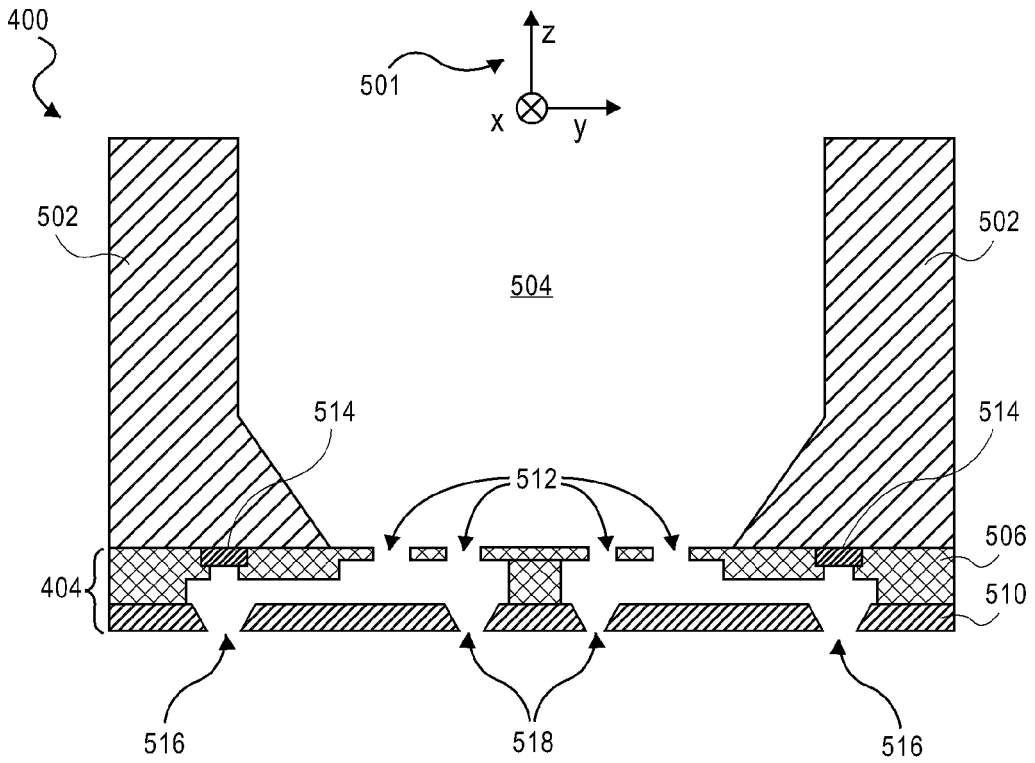
FIG. 3 is a diagram of a portion of an inkjet printhead, according to an embodiment of the present disclosure.

FIG. 3 shows a portion of the inkjet printhead 400 in more detail, according to an embodiment of the present disclosure. Reference number 501 denotes the x-, y-, and z-axes in FIG. 3. The inkjet printhead 400 includes chamber sidewalls 502 that define a chamber 504 to which ink can be supplied. The chamber 504 is capped by the printhead die 404. That is, the chamber 504 ends at one side thereof at the printhead die 404 (and it can be said that the chamber 504 ends at any layer of the die 404 in this respect). In one embodiment, the printhead die 404 may be considered as having at least two layers 506 and 510. However, in other embodiments, the die 404 may have fewer or greater layers than two layers as depicted in FIG. 3. Additionally, those of ordinary skill within the art can appreciate that each of the layers 506 and 510 may itself be made up of more than one layer.

The layer 506 defines a number of inlet holes 512 that permit the ink within the chamber 504 to pass from the chamber 504 to the printhead die 404. Situated at or part of the layer 506 are a number of fluid-ejection elements 514, such as heating elements like resistive heating elements, piezo elements such as piezo-electric elements, as well as other types of fluid-ejection elements. Furthermore, the layer 510 may be referred to as an orifice plate. The layer 510 defines a number of holes 516 and a number of holes 518. The holes 516 may be referred to as first holes and the holes 518 may be referred to as second holes to distinguish the holes 516 from the holes 518. Furthermore, the first holes 516 may be referred to as the inkjet nozzles of the inkjet printhead 400.

As depicted in FIG. 3, the first holes 516 and the second holes 518 may have substantially identical profiles, such as tapered profiles as in FIG. 3. It is also noted that in one embodiment, the first holes 516 are not located directly below or under the chamber 504 and instead are located directly below or under the chamber sidewalls 502, whereas the second holes 518 are located directly below or under the chamber 504, as opposed to directly below or under the chamber sidewalls 502. However, in another embodiment, the first holes 516 and the second holes 518 may be both located directly below the chamber 504, or may be both located not directly below the chamber 504. In still another embodiment, the second holes 518 may be located directly below the chamber sidewalls 502, while the first holes 516 may be located directly below the chamber 504.

Each of the first holes 516 corresponds to one of the fluid-ejection elements 514, such that the first holes 516 may be positioned directly underneath the elements 514 in one embodiment. It is noted that by comparison, there is no fluid-ejection element 514 at any of the second holes 518; rather, there is just a fluid-ejection element 514 at each of the first holes 516 in the embodiment of FIG. 3. During usage of the inkjet printhead 400 to form images on media (i.e., to precisely dispense fluid at accurately specified locations), when a desired first hole 516 is to have an ink droplet ejected therefrom, the corresponding fluid-ejection element 514 is activated. Activation of the fluid-ejection element 514 ultimately causes an ink droplet to be ejected from the corresponding first hole 516.

For example, in a particular embodiment in which the fluid-ejection elements 514 are resistive heating elements, activation of a fluid-ejection element 514 means that a sufficient current is passed through the element 514 to heat the element 514. As such, the ink around the fluid-ejection element 514 in question at least substantially boils, forming a small gaseous bubble within this ink. The bubble in turn forcibly ejects a droplet of ink through the corresponding first hole 516.

Therefore, during usage of the inkjet printhead 400 to form images on media (i.e., to precisely dispense fluid at accurately specified locations), ink passes through the first holes 516, such that it can be said that the first holes 516 are adapted to pass such fluid therethrough during such usage of the printhead 400. By comparison, during usage of the printhead 400 to form images on media (i.e., to precisely dispense fluid at accurately specified locations), ink does not pass through the second holes 518. Therefore, it can be said that the second holes 518 are adapted to not pass such fluid therethrough during such usage of the printhead 400.

It is noted, however, that in another embodiment, there may be fluid-ejection elements at one or more of the second holes 518. In such an embodiment, the fluid-ejection elements at the second holes 518 are not employed during usage of the inkjet printhead 400 to form images on media (i.e., to precisely dispense fluid at accurately specified locations). Rather, the fluid-ejection elements at the second holes 518 are employed during performance of priming operations, which are described in more detail later in the detailed description, to assist in eject ink during from these second holes 518 during such priming operations.

In general, the second holes 518 are adapted to not pass ink therethrough during usage of the inkjet printhead 400 to form images on media (i.e., to precisely dispense fluid at accurately specified locations) by having critical pressures that have absolute values which are greater than (i.e., or otherwise appropriate to) absolute values of the backpressures at the second holes 518. The critical pressure is the pressure at which the meniscus of fluid at a second hole 518 is detached, initiating the flow of ink, air, sludge, and/or contaminants through the second hole 518 in question. By ensuring that the critical pressure at each second hole 518 is greater in absolute value than (i.e., or otherwise appropriate to) the absolute value of the backpressure experienced during usage of the inkjet printhead 400 to form images on media, it is ensured that ink does not flow through the second hole 518 in question during such usage of the printhead 400. It is noted that the critical pressure as to air or other gas can be particularly referred to as bubble pressure, whereas the terminology critical pressure is more general, and relates more generally to ink, air, sludge, and/or contaminants.

Furthermore, ensuring that the critical pressure at each second hole 518 is greater than the backpressure during usage of the inkjet printhead 400 to form images on media (i.e., to precisely dispense fluid at accurately specified locations), gas such as air is at least substantially prevented from being introduced into the chamber 504 through the second hole 518 in question. Ensuring that the critical pressure at each second hole 518 is greater than the backpressure during such usage of the printhead 400 can be achieved by appropriately sizing each second hole 518. Additionally or alternatively, ensuring that the critical pressure at each second hole 518 is greater than the backpressure can be achieved by appropriately shaping each second hole 518. For a given design of the inkjet printhead 400, the appropriate size and/or shape of each second hole 518 in this respect can be determined experimentally.

Figure 4:
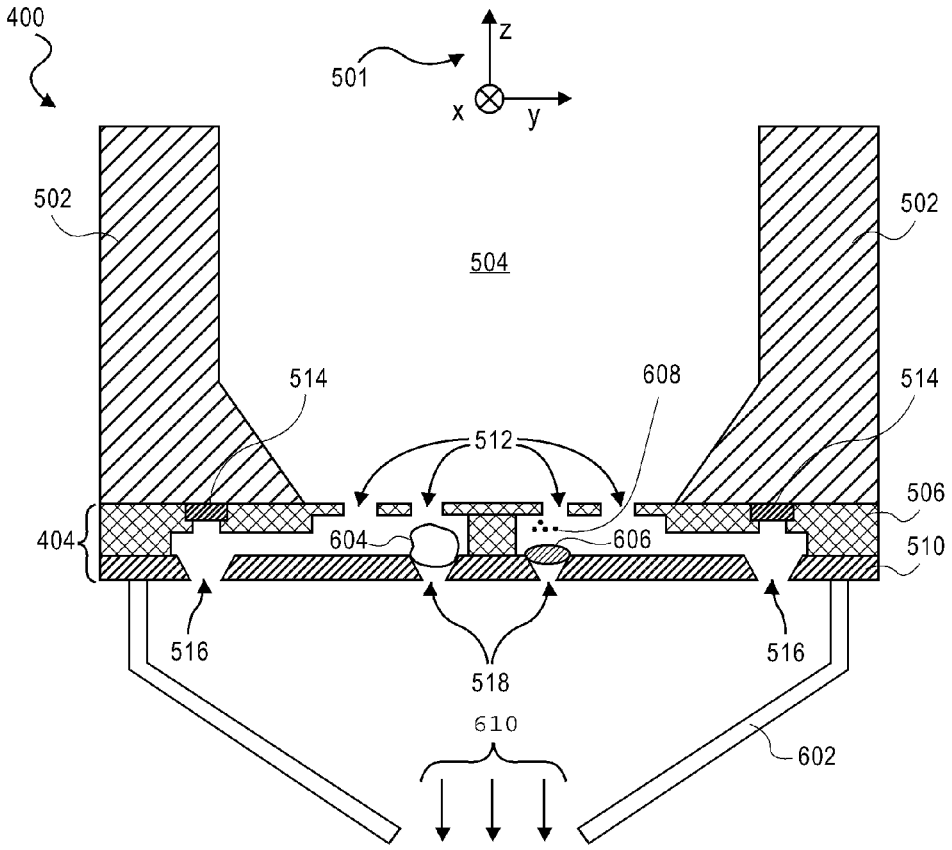
FIG. 4 is a diagram of a portion of an inkjet printhead during performance of a priming operation, according to an embodiment of the present disclosure.

FIG. 4 representatively depicts a priming operation being performed in relation to the inkjet printhead 400, according to an embodiment of the invention. Reference number 501 again denotes the x-, y-, and z-axes in FIG. 4. A priming operation is generally an operation in which a pressure differential is actively employed, such as by attaching a cap, or a primer, 602 to the printhead 400 to form a seal around the first holes 516 and the second holes 518. Fluid movement through the holes 516 and 518 results from this pressure differential.

For example, in the specific embodiment depicted of FIG. 4, a particular type of priming operation referred to as a suction prime is shown. In a suction prime, a negative pressure around the holes 516 and 518 is created by a suction or vacuum effect, as is particularly indicated by the arrows 610. By comparison, another type of priming operation is known as a push prime. In a push prime, a positive pressure around the holes 516 and 518 is created.

During the life of the inkjet printhead 400, gas such as air may be introduced into the printhead 400, resulting in formation of gaseous bubbles 604. During usage of the inkjet printhead 400 to form images on media (i.e., to precisely dispense fluid at accurately specified locations), such bubbles 604 can deleteriously affect image quality. More generally, the gaseous bubbles 604 can affect the precise dispensation of fluid at accurately specified locations.

Similarly, during the life of the inkjet printhead 400, sludge 606 may collect, accumulate, or otherwise form within the printhead 400, due to the drying of the ink resulting in the ink losing at least some of its liquid component, or the ink itself changing over time. For instance, the ink may settle, flocculate, aggregate, and so on. Furthermore, during the life of the inkjet printhead 400, the ink may become subjected to contamination from contaminants 608 such as dust and other types of contaminants from both inside and outside the printhead 400. As such, during use of the inkjet printhead 400 to form images on media (i.e., to precisely dispense fluid at accurately specified locations), the sludge 606 and the contaminants 608 can deleteriously affect image quality. More generally, the sludge 606 and the contaminants 608 can affect the precise dispensation of fluid at accurately specified locations.

During performance of the priming operation, the gaseous bubbles 604, the sludge 606, and the contaminants 608 are actively removed from the inkjet printhead 400. As such, image quality is subsequently not affected when the printhead 400 is subsequently used to form images on media. That is, when the printhead 400 is subsequently used to precisely dispense fluid at accurately specified locations, the prior at least substantial removal of the gaseous bubbles 604, the sludge 606, and the contaminants 608 promotes optimal such precise dispensation of fluid at accurately specified locations.

The sludge 606 may have dried in portions that are larger in size than the first holes 516. Therefore, in an embodiment in which the second holes 518 are larger in size than the first holes 516 are, the sludge 606 is more easily removed during performance of the priming operation. For instance, the second holes 518 may be a priori sized so that they are larger than what empirical tests reveal to be the maximum size of the portions of the sludge 606. As a result, removal of the sludge 606 is achieved through the second holes 518 at a lower fluid flow rate resulting from the suction effect than would otherwise be needed if removal of the sludge 606 were achieved through the first holes 516. Indeed, such larger portions of the sludge 606 may otherwise undesirably plug the first holes 516 during performance of the priming operation but for the presence of the second holes 518.

Sizing the second holes 518 larger than the first holes 516 also can improve removal of the gaseous bubbles 604 from the inkjet printhead 400, at least insofar as there are more routes available for the bubbles 604 to be removed from the printhead 400 when the second holes 518 are present in addition to the first holes 516 being present. Other advantages and aspects of embodiments of the present disclosure that are associated with having the second holes 518 present during performance of the priming operation are discussed later in the detailed description. In general, however, the second holes 518 can be said to be adapted to at least substantially maximally pass the gaseous bubbles 604, the sludge 606, and/or the contaminants 608 therethrough during performance of the priming operation.

Figure 5:
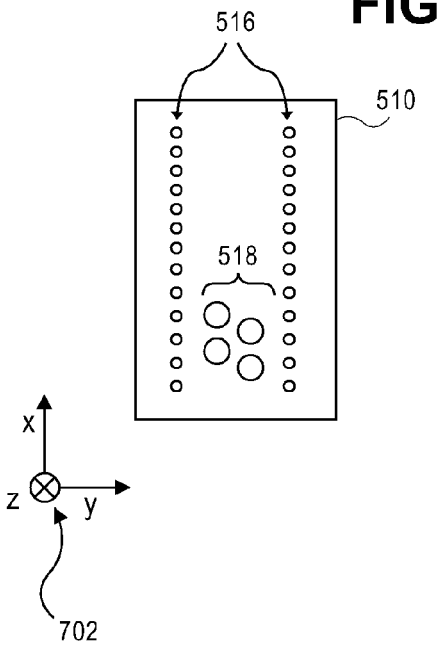
FIGS. 5, 6, 7, and 8 are diagrams depicting the locational positioning of holes within an inkjet printhead, according to varying embodiments of the present disclosure.

FIG. 5 shows how the first holes 516 and the second holes 518 may be located on the layer 510 of the inkjet printhead 400, according to an embodiment of the present disclosure. Reference number 702 denotes the x-, y-, and z-axes in FIG. 5. The first holes 516 are positionally arranged in two columns over the long side of the layer 510, parallel to the x-axis. (It is noted that the arrangements of the holes 516 and 518 depicted in FIG. 5 and the other figures are particular to specific embodiments, while in other embodiments other arrangements of the holes 516 and 518 may be achieved.) In general, the distance between the first of the first holes 516 and the last of the first holes 516 within either of the two columns corresponds to the swath of the printhead 400, which is the distance over which ink can be ejected without having to move the printhead 400 or the media along the x-axis.

It has been determined that for many designs of inkjet printheads, gaseous bubbles, sludge, and/or contaminants tend to migrate to one side of a given printhead or the other side of the printhead along the x-axis. Therefore, in the embodiment of FIG. 5, the second holes 518 are positionally located at or towards the side of the printhead 400 at which gaseous bubbles, sludge, and/or contaminants tend to migrate. This is advantageous, as it decreases the amount of ink (i.e., fluid) that is used during performance of the priming operation, and/or the duration of the priming operation.

That is, if gaseous bubbles, sludge, and/or contaminants tend to migrate to just one side of the printhead 400 along the x-axis, but if the second holes 518 are positioned over both sides, the net effect is that the priming operation results in more ink being used than may be needed. Because the priming operation is intended to remove gaseous bubbles, sludge, and/or contaminants, strategically locating the second holes 518 on the side where it has been empirically determined that these bubbles, sludge, and/or contaminants tend to migrate reduces the amount of ink expunged from the printhead 400 during performance of the priming operation.

Figure 6:
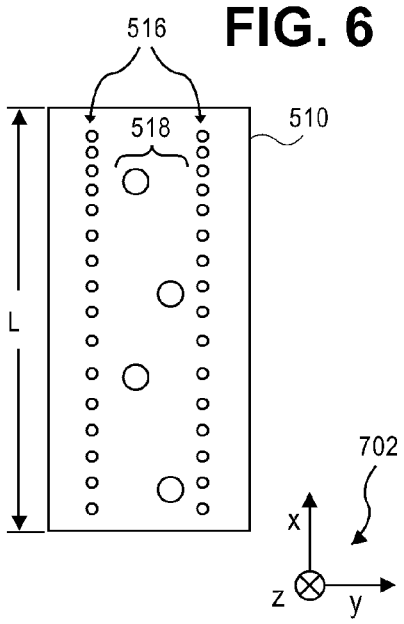

FIG. 6 shows how the first holes 516 and the second holes 518 may be located on the layer 510 of the inkjet printhead 400, according to another embodiment of the present disclosure. Reference number 702 again denotes the x-, y-, and z-axes in FIG. 6. The first holes 516 can be positionally arranged in two columns over the long side of the layer 510, parallel to the x-axis. The length of the layer 510, denoted by the letter L in FIG. 6, is longer than the length of the layer 510 in FIG. 5. This can be advantageous, as it provides for a larger swath of the printhead 400, which generally equates to faster printing. The layer 510 may thus be considered a long layer.

A general disadvantage of having such a long layer 510 as in FIG. 6 is that it has been determined that, in general, performance of the priming operation has to occur at a relatively high fluid flow rate of ink from the inkjet printhead 400 where the second holes 518 are not present. A relatively high fluid flow rate is disadvantageous because it increases the amount of fluid that is used during performance of the priming operation. However, the presence of the second holes 518 has been found to permit performance of the priming operation to be able to occur at a lower fluid flow rate of ink from the inkjet printhead 400. As such, the amount of fluid used during performance of the priming operation is decreased.

In particular, the size, shape, and/or number of the second holes 518 can be empirically tested to provide for the lowest fluid flow rate of ink from the inkjet printhead 400 during performance of the priming operation, while still providing for satisfactory removal of gaseous bubbles, sludge, and/or contaminants. A lower fluid flow rate is generally achieved by decreasing the pressure against the layer 510 during performance of the priming operation. This is also advantageous because it at least substantially prevents additional gas from being introduced into the printhead 400 elsewhere.

For example, if the negative pressure against the layer 510 is too great during performance of the priming operation, gas may be suctioned into the inkjet printhead 400 at fluid interconnect interfaces and at other locations around the printhead 400. As such, while gaseous bubbles may be removed from the printhead 400 during such priming, further gaseous bubbles are inadvertently and nevertheless formed. Therefore, the presence of the second holes 518, by permitting the negative pressure against the layer 510 to be lowered during performance of the priming operation, at least substantially ameliorates this problem.

Figure 7:
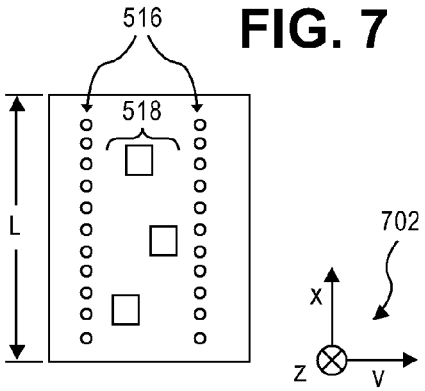

FIG. 7 shows how the first holes 516 and the second holes 518 may be located on the layer 510 of the inkjet printhead 400, according to still another embodiment of the present disclosure. Reference number 702 as before denotes the x-, y-, and z-axes in FIG. 7. The first holes 516 are as before positionally arranged in two columns over the long side of the layer 510, parallel to the x-axis. The length of the layer 510, again denoted by the letter L in FIG. 7, is shorter than the length of the layer 510 in FIG. 5. This can be advantageous, in that it may be less expensive to manufacture shorter printheads. The layer 510 may thus be considered a short layer.

A general disadvantage of having such a short layer 510 as in FIG. 7 is that it has been determined that, in general, performance of the priming operation takes a relatively long length of time to complete, due to the relatively low fluid flow rate of ink from the inkjet printhead 400 where the second holes 518 are not present. A relatively low fluid flow rate is disadvantageous because it causes the priming operation to take a long time to complete. However, the presence of the second holes 518 has been found to improve performance of the priming operation by decreasing the length of time in which priming is completed, due to the fluid flow rate increasing as a result of the second holes 518.

In particular, the size, shape, and/or number of the second holes 518 can be empirically tested to provide for an increased fluid flow rate of ink from the inkjet printhead 400, while still not resulting in a sufficiently high fluid flow rate that results in the disadvantages described in relation to FIG. 6 above. In one embodiment, for instance, the second holes 518 may be rectangularly shaped, as is specifically shown in FIG. 7. Rectangular holes 518 can be advantageous over round holes 518 in that they provide for an increased flow rate through the second holes 518 during performance of the priming operation without decreasing the critical pressure at each second hole 518. Other types of shapes of the second holes 518 can include stars, triangles, ovals, and so on.

Figure 8:
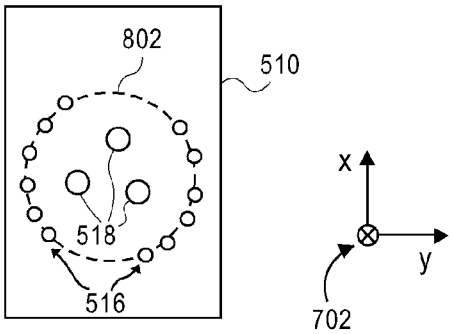

FIG. 8 shows how the first holes 516 and the second holes 518 may be located on the layer 510 of the inkjet printhead 400, according to another embodiment of the present disclosure. Reference number 702 denotes the x-, y-, and z-axes in FIG. 8. The first holes 516 are positionally arranged around the circumference of an imaginary circle 802. By comparison, the second holes 518 are positionally arranged within a center of the circle 802.

Figure 9:
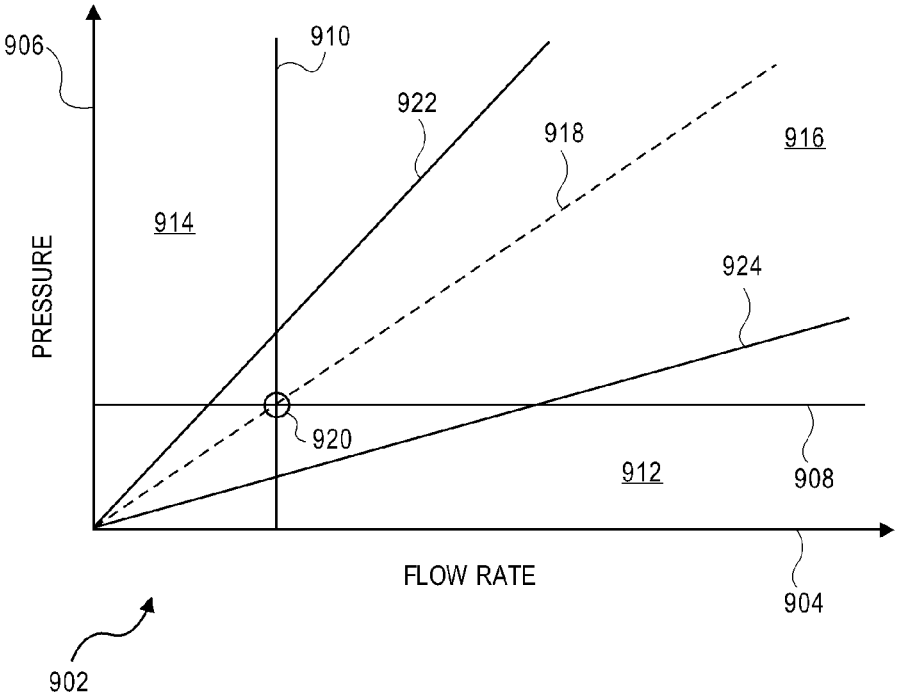
FIG. 9 is a graph depicting the relationship between flow rate and pressure for a design of an inkjet printhead, by which the placement and size of holes within the printhead can be determined, according to an embodiment of the present disclosure.

FIG. 9 shows a graph 900 depicting the relationship between flow rate and pressure, which can be used to properly design the number and size of the second holes 518 within the inkjet printhead 400, according to an embodiment of the present disclosure. The x-axis 904 denotes flow rate, while the y-axis 906 denotes the pressure differential across the layer 510 of the inkjet printhead 400. The horizontal line 908 defines a critical pressure-limited region 912; any pressure below the horizontal line 908 is below the critical pressure for any given flow rate. By comparison, the vertical line 910 defines a critical flow rate-limited region 910; any flow rate to the left of the vertical line 910 is below the critical flow rate for any given pressure. The critical flow rate is a flow rate at which fluid, air, sludge, and contaminants move through the first holes 516 and/or the second holes 518.

Furthermore, the horizontal line 908 and the vertical line 910 together define an ideal region 916. Any flow rate to the right of the vertical line 910 at any pressure above the horizontal line 908 permits fluid, air, sludge, and/or contaminants to move through the first holes 516 and/or the second holes 518 without realizing a pressure below the critical pressure. Thus, for a given critical flow rate denoted by the vertical line 910, there is an ideal relationship between flow rate and pressure denoted by the line 918. The intersection point 920 of the lines 908 and 910 particularly denotes the lowest pressure and flow rate combination to move fluid, air, sludge, and/or contaminants to move through the first holes 516 and/or the second holes 518.

The flow rate-pressure characteristics of two example designs of the inkjet printhead 400 having first holes 516 within the layer 500—prior to the inclusion of second holes 518—are depicted in FIG. 9 by the lines 922 and 924. The line 922 represents an example design that is flow rate-limited, insofar as the line 922 crosses the vertical line 910 after it crosses the horizontal line 908 when starting at the origin of the graph 902. By comparison, the line 924 represents an example design that is pressure-limited, insofar as the line 924 crosses the horizontal line 908 after it crosses the vertical line 910 when starting at the original of the graph 902.

Thus, the purpose of adding the second holes 518 varies between the flow rate-limited design represented by the line 922 and the pressure-limited design represented by the line 924. In the flow-rate limited design represented by the line 922, the second holes 518 may be added to increase flow at lower pressures, to decrease the slope of the line 922 to approach the ideal relationship between flow rate and pressure denoted by the line 918. By comparison, in the pressure-limited design represented by the line 924, the second holes 518 may be added to decrease the critical pressure, thereby decreasing the required flow rate, and to increase the slope of the line 924 to approach the ideal relationship between flow rate and pressure denoted by the line 918.

Embodiments of the present disclosure have been described in which the location, size, shape, and number of the second holes 518 can be varied to achieve optimal removal of gaseous bubbles, sludge, and contaminants from the printhead 400 during performance of the priming operation. Depending on where the gaseous bubbles, sludge, and contaminants are determined to typically migrate, for instance, the location of the second holes 518 can be correspondingly placed after empirical testing. Depending on whether the printhead 400 is long or short, for instance, the size, shape and number of the second holes 518 can be specified after empirical testing to decrease or increase fluid flow rate, as desired, during performance of the priming operation. Finally, it is noted that the first holes 516 and the second holes 518 may be considered as particular means for performing their respective functionalities described herein.

We claim:

1. A fluid-jet precision-dispensing device comprising:

a first layer defining a first chamber;

a second layer defining a second chamber below the first chamber, the second chamber fluidically coupled to the first chamber, the second chamber having a lesser height than the first chamber and a greater width than the first chamber;

one or more actuators within the second layer;

one or more first holes within the second layer and opposite the one or more actuators, the first holes adapted to pass fluid therethrough upon ejection by the actuators during usage of the device to precisely dispense the fluid at accurately specified locations; and, one or more second holes within the second layer, the second holes adapted to not pass the fluid therethrough during usage of the device to precisely dispense the fluid at the accurately specified locations, the second holes further adapted to one or more of:

pass gaseous bubbles therethrough during performance of a priming operation of the device; and, pass sludge and/or contaminants therethrough during performance of the priming operation of the device, wherein the second holes are sized and/or shaped to ensure that a critical pressure at each second hole has an absolute value greater than an absolute value of a backpressure at each second hole during the usage of the device.

2. The device of claim 1, wherein the priming operation of the device comprises formation of a seal around the first holes and the second holes and actively moving fluid through the first holes and/or the second holes to at least substantially remove the gaseous bubbles, sludge, and/or the contaminants.

3. The device of claim 1, wherein the gaseous bubbles, the sludge, and/or the contaminants migrate to one side of the layer, such that the second holes are located at the one side of the layer, to decrease an amount of fluid used during performance of the priming operation of the device and/or a duration of the priming operation.

4. The device of claim 1, wherein the second holes are sized, shaped, and/or numbered to decrease a flow of the fluid during performance of the priming operation of the device to one or more of:

decrease an amount of fluid used during performance of the priming operation of the device; and, at least substantially prevent additional gas from being introduced into the device.

5. The device of claim 1, wherein the second holes are sized, shaped, and/or numbered to increase a flow rate of the fluid during performance of the priming operation of the device to improve performance of the priming operation.

6. The device of claim 1, wherein the second holes are larger in size than the first holes are, such that performance of the priming operation results in one or more of:

at least substantial removal of the sludge and/or the contaminants through the second holes without the sludge plugging the first holes; and, improved removal of the gaseous bubbles from the device.

7. The fluid-jet precision-dispensing device of claim 1, wherein the first holes and the second holes are asymmetrically positioned in relation to the first chamber.

8. The fluid-jet precision-dispensing device of claim 1, wherein the second layer includes a post centrally dividing a first half of the second chamber from a second half of the second chamber, the one or more first holes and the one or more second holes located in the first half of the second chamber, the first holes and the second holes asymmetrically positioned in relation to the first chamber.

9. The fluid-jet precision-dispensing device of claim 8, further comprising one or more third holes of a same type as the first holes, and one or more fourth holes of a same type as the second holes, the third holes and the fourth holes located in the second half of the second chamber in a mirrored relationship with respect to the first holes and the second holes.

10. A fluid-jet precision-dispensing device comprising:

a first layer defining a first chamber;

a second layer defining a second chamber below the first chamber, the second chamber fluidically coupled to the first chamber, the second chamber having a lesser height than the first chamber and a greater width than the first chamber;

one or more actuators within the second layer;

one or more first holes within the second layer and opposite the one or more actuators, the first holes adapted to pass fluid therethrough upon ejection by the actuators during usage of the device to precisely dispense the fluid at accurately specified locations;

one or more second holes within the second layer and not opposite the one or more actuators, the second holes adapted to not pass the fluid therethrough during usage of the device to precisely dispense the fluid at the accurately specified locations, the second holes further adapted to one or more of:

pass gaseous bubbles therethrough during performance of a priming operation of the device; and, pass sludge and/or contaminants therethrough during performance of the priming operation of the device.

11. The fluid-jet precision-dispensing device of claim 10, wherein the first holes and the second holes are asymmetrically positioned in relation to the first chamber.

12. The fluid-jet precision-dispensing device of claim 10, wherein the second layer includes a post centrally dividing a first half of the second chamber from a second half of the second chamber, the one or more first holes and the one or more second holes located in the first half of the second chamber, the first holes and the second holes asymmetrically positioned in relation to the first chamber.

13. The fluid-jet precision-dispensing device of claim 12, further comprising one or more third holes of a same type as the first holes, and one or more fourth holes of a same type as the second holes, the third holes and the fourth holes located in the second half of the second chamber in a mirrored relationship with respect to the first holes and the second holes.

14. A fluid-jet precision-dispensing device comprising:

a housing;

one or more cartridges insertable into the housing, each cartridge comprising:

a first layer defining a first chamber;

a second layer defining a second chamber below the first chamber, the second chamber fluidically coupled to the first chamber, the second chamber having a lesser height than the first chamber and a greater width than the first chamber;

one or more actuators within the second layer;

one or more first holes within the second layer and opposite the one or more actuators, the first holes adapted to pass fluid therethrough upon ejection by the actuators during usage of the device to precisely dispense the fluid at accurately specified locations; and, one or more second holes within the second layer, the second holes adapted to not pass the fluid therethrough during usage of the device to precisely dispense the fluid at the accurately specified locations, the second holes further adapted to one or more of:

pass gaseous bubbles therethrough during performance of a priming operation of the device; and, pass sludge and/or contaminants therethrough during performance of the priming operation of the device, wherein the second holes are sized and/or shaped to ensure that a critical pressure at each second hole has an absolute value greater than an absolute value of a backpressure at each second hole during the usage of the device.

15. The fluid-jet precision-dispensing device of claim 14, wherein the first holes and the second holes are asymmetrically positioned in relation to the first chamber.

16. The fluid-jet precision-dispensing device of claim 14, wherein the second layer includes a post centrally dividing a first half of the second chamber from a second half of the second chamber, the one or more first holes and the one or more second holes located in the first half of the second chamber, the first holes and the second holes asymmetrically positioned in relation to the first chamber.

17. The fluid-jet precision-dispensing device of claim 16, wherein each cartridge further comprises one or more third holes of a same type as the first holes, and one or more fourth holes of a same type as the second holes, the third holes and the fourth holes located in the second half of the second chamber in a mirrored relationship with respect to the first holes and the second holes.

* * * * *